US005249691A

United States Patent [19]

Mizrahi

[11] Patent Number: 5,249,691

[45] Date of Patent: Oct. 5, 1993

[54] MINIATURE GLASS HAVING A SWIZZLE STICK WITH AN ATTACHMENT CAPABILITY TO A DRINKING VESSEL

[76] Inventor: Shulamit Mizrahi, P.O. Box 4220, New York, N.Y. 10185-0036

[21] Appl. No.: 754,046

[22] Filed: Sep. 3, 1991

[30] Foreign Application Priority Data

Apr. 7, 1991 [IL] Israel ..... 097785

[51] Int. Cl.[5] ..... A47G 19/22; A47G 19/30; A47G 21/00; A47G 21/12

[52] U.S. Cl. ..... 215/100 R

[58] Field of Search ..... 446/71, 75, 76, 77; D7/300.2, 684; 215/100 R; 366/129, 343

[56] References Cited

U.S. PATENT DOCUMENTS

| | | | |
|---|---|---|---|
| D. 84,064 | 4/1931 | Trumbull | D7/300.2 |
| D. 168,706 | 1/1953 | Osborn | D7/300.2 |
| D. 184,335 | 2/1959 | Bergeron | D7/684 |
| D. 225,486 | 12/1972 | Bart | D7/300.2 |
| 1,262,331 | 6/1930 | Greist | 215/100 R |
| 2,079,193 | 5/1937 | Wigen | D7/683 X |
| 2,327,077 | 8/1943 | Teetor | D7/300.2 X |
| 2,370,931 | 3/1945 | Bogin et al. | D7/300.2 X |
| 3,431,041 | 3/1969 | Fontlladosa | 215/100 R |
| 3,488,769 | 1/1970 | Falkenberg | D7/300.2 X |
| 3,834,068 | 9/1974 | Fabricant | 446/74 |

FOREIGN PATENT DOCUMENTS

| | | | |
|---|---|---|---|
| 703129 | 2/1965 | Canada | 215/100 R |
| 1322928 | 2/1963 | France | D7/300.2 |

*Primary Examiner*—Sue A. Weaver

[57] ABSTRACT

This invention pertains to a miniature container in the form of a cup with an attachment part. The miniature container can be easily attached to a regular receptacle by a swizzle stick which has a catch hook in its lower edge. The miniature glass can be used as a small container and has an additional part that may be used as a small mixer for drinks. It also has a small place for personal toothpicks. The miniature glass also has a cover attached to its upper edge. The cover can be opened and closed flexibly. Usually the miniature glass is a small replica of the regular receptacle to which it is attached.

2 Claims, 1 Drawing Sheet

FIG. 1
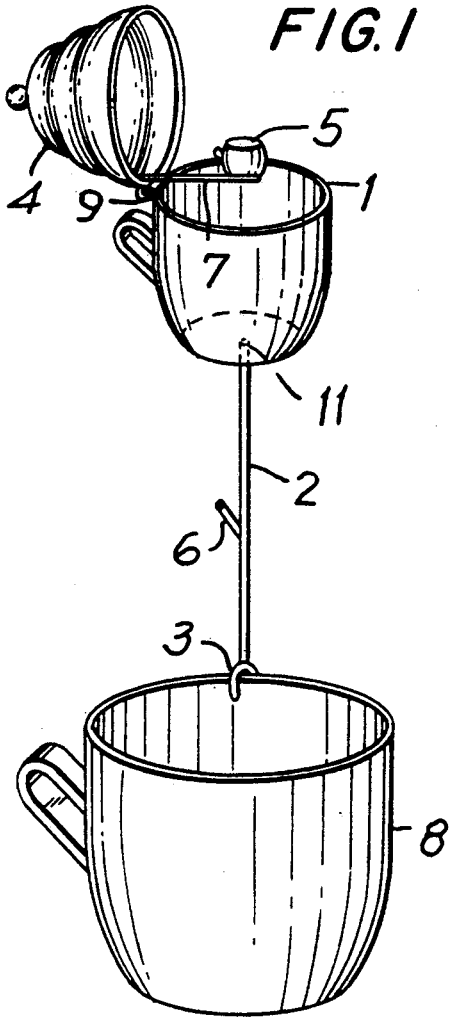
FIG. 2
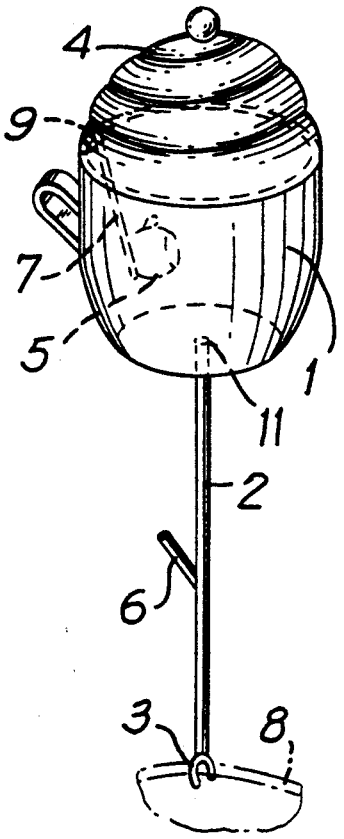
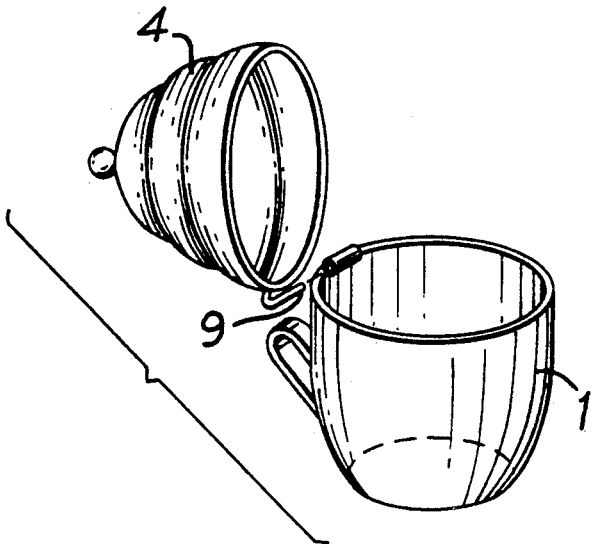
FIG. 3

MINIATURE GLASS HAVING A SWIZZLE STICK WITH AN ATTACHMENT CAPABILITY TO A DRINKING VESSEL

BRIEF SUMMARY OF THE INVENTION

It is often desirable in the food, beverage service fields such as restaurants, Coffee Shops, Cocktails Lounges and indeed at other social occasions to have a serving apparatus which combines and fits a few functions all together in a very comfortable and useful way. In general, the invention relates to a miniature container with an attachment part which has a decorative appearance, added as part of the service to a regular receptacle to which it is attached, to provide satisfactory and amusement means for adults as well as for children, whether it takes the form of a wine glass, coffee cup, juice glass as a replica of the regular receptacle to which it is attached.

In addition, the volume of the miniature glass can be used as a small container for cherry, olive or as a small container for samples of drinks (specially alcoholic drinks) added as an extra treat to the customer, also it can be used as a container for small poblicity notes, prizes, small gifts etc.

The swizzle stick which has a catch hook in its lower edge is used as an attachment part to a regular receptacle served with it, as well as a tiny mixer for drinks served in the regular receptacle to which it is attached.

The socket which is localized in the middle of the swizzle stick can be used as a small place to put personal toothpicks which can be used both as a tooth cleaner at the end of the meal as well as a holder for olives cherries etc.

In order to make the function of the invention more interesting there is a cover conected to the edge of the miniature glass by a hinge. Usually the cover appears as a miniature replica of the contents served in the regular receptacle whether it is a whipped cream, fruit salad etc.

An additional part is a small stick attached to the edge of the inner side of the cover. The small stick has a miniature apparatus on it. The cover can be opened and closed flexibly since it is conected to the upper edge of the miniature glass by a hinge. The small stick goes up and down according to the cover's position.

It is an object of the invention to provide a miniature decoration and service glass that can be used as a small container.

It is another object of the invention to provide a miniature glass with a swizzle stick that in addition to its attachment function can be used as a tiny mixer for drinks.

It is another object of the invention to provide a miniature container that usually appears as a miniature replica of the regular receptacle to which it is attached.

It is another object of the invention to provide a miniature glass having a cover which is attached to its upper edge by a hinge.

BRIEF DESCRIPTION OF THE DRAWINGS

FIG. 1 Showing an example of the miniature glass with all its components attached to a regular cup by the catch hook which is localized at the lower edge of the swizzle stick. The miniature glass is in a position where the cover is open and the small stick in the inner side of the miniature glass is up.

FIG. 2 Showing the miniature glass in a position where the cover is closed. It is a view taken along the inner side of the miniature glass to show the position where the small stick is down inside the miniature glass when the cover is closed.

FIG. 3 Is a view taken along component #9 of the miniature glass. It is the hinge which is conecting the cover to the upper edge of the miniature glass

DESCRIPTION OF THE BEST EMBODIMENTS CONTEMPLATED

Referring to the figures of drawing it will be noted in this particular instance, a miniature glass made of plastic has usually different configurations and forms typically used as a replica of the regular receptacle to which it is attached. It is contemplated that other materials of construction for glass may be used, whether it to be actual glass, plastic, metal and any such material of configuration, all of which are readily known in the art.

A cover (4) conected to the upper edge of the miniature glass by a hinge (9 & FIG. #3) has the form of a whipped cream (4). It is of course possible that the cover (4) may have other forms rather than the example shown in the drawings.

It is noted that the small stick (7) which is attached to the inner edge of the cover (4) as well as the swizzle stick (2) which is conected to the miniature glass (11) are all attached by means of bonding, adhesive or any similar such securement depending upon the material of construction of the miniature glass (1).

Under the swizzle stick (2) there is the catch hook (3) which fits as an attachment part to the regular receptacle (8) to which the miniature glass (1) is attached.

In the middle of the swizzle stick (2) there is the socket (6) which can be used as a small place for personal toothpicks. Suffice to say that the small stick (7) is attached to the inner edge of the cover (4) as to cooperate and achieve the harmony representation with the cover (4). When the cover is up (4) as seen on FIG. #1 the small stick (7) and the small apparatus on it (5) are up, and when the cover is closed (4) as seen on FIG. 2 the small stick (7) and the miniature apparatus on it (5) are down inside the miniature glass (1).

In this particular instance, the miniature glass usually appears as a small replica of the regular receptacle to which it is attached. As seen on FIG. #1: A regular cup (8) to which the miniature glass (1) is attached as its replica.

The small glass (5) which is attached to the small stick (7) can have different forms to coincide with the special usage of the miniature glass (1), For example—it may have the form of miniature dolls of bride and groom attached to the small stick (7) when the miniature glass (1) is being used at a wedding party. Obviously, it is of course within the contemplation of the invention that the miniature glass (1) may take other forms of representation rather than the form shown in the drawings. While the invention has been described with respect to its attachment system (2 & 3) the miniature glass (1) can indeed have any other figure rather that the example shown in the drawing.

Thus there has been disclosed a unique miniature novelty, decoration and service glass which has the function to fit as an attached part to a regular receptacle (8) by a catch hook (3) which is conected to the lower edge of the swizzle stick (2).

It is within the contemplation of the invention that the miniature glass (1) which is attached to a regular receptacle (8) by a catch hook (3) which fits as an attachment part to the upper edge of the regular receptacle (8), can be detached from the regular receptacle (8).

Various modifications, alterations and changes will at once make themselves apparent to those of ordinary skill in the art and all such changes, modifications and alterations are intended tov be covered by the claim.

I claim:

1. An attachment adapted to be connected to a rim of a drinking vessel comprising: a swizzle stick having a catch hook at one end for grasping the top edge of the vessel, a miniature vessel attached at the other end of the stick having a closure and a hinge for fastening the closure to a top opening of the miniature vessel, a socket means located intermediate said catch hook and said miniature vessel for holding a toothpick.

2. The attachment of claim 1 wherein a small apparatus includes means for attaching said apparatus to the interior of the miniature vessel.

* * * * *